US007053292B2

(12) United States Patent
Lucat

(10) Patent No.: US 7,053,292 B2
(45) Date of Patent: May 30, 2006

(54) DEVICE COMPRISING A SOUND SIGNAL GENERATOR AND METHOD FOR FORMING A CALL SIGNAL

(75) Inventor: Laurent Lucat, Le Mans (FR)

(73) Assignee: Koninkijke Philips Electronics N.V., Eindhoven (NL)

( * ) Notice: Subject to any disclaimer, the term of this patent is extended or adjusted under 35 U.S.C. 154(b) by 348 days.

(21) Appl. No.: 10/253,773

(22) Filed: Sep. 24, 2002

(65) Prior Publication Data

US 2003/0070536 A1 Apr. 17, 2003

(30) Foreign Application Priority Data

Sep. 28, 2001 (FR) ..... 01 12511

(51) Int. Cl.
*G10H 7/00* (2006.01)

(52) U.S. Cl. ..... 84/610; 84/613; 84/634; 84/637

(58) Field of Classification Search ..... 84/610, 84/613, 634, 637

See application file for complete search history.

(56) References Cited

U.S. PATENT DOCUMENTS

| | | | | |
|---|---|---|---|---|
| 4,951,544 A | | 8/1990 | Minamitaka | 84/613 |
| 5,510,572 A | * | 4/1996 | Hayashi et al. | 84/609 |
| 5,883,326 A | * | 3/1999 | Goodman et al. | 84/649 |
| 6,060,655 A | | 5/2000 | Minamitaka | 84/650 |

FOREIGN PATENT DOCUMENTS

| | | | |
|---|---|---|---|
| EP | 1073034 A2 | | 1/2001 |
| JP | 02197885 A | * | 8/1990 |

OTHER PUBLICATIONS

Mokry et al: "Minimal Error Drift in Frequency Scalability for Motion–Compensated OCT Coding" IEEE Transactions On Circuits And Systems For Video Technology, vol. 4, No. 4, Aug. 1994, pp. 392–406.

* cited by examiner

*Primary Examiner*—David Martin
*Assistant Examiner*—David S. Warren
(74) *Attorney, Agent, or Firm*—Gregory L. Thorne

(57) ABSTRACT

This device (1) enables the user to personalize the call signal (ringing) which it is called on to deliver. This personalization consists of transforming a melody (FIG. 1) which the user hums into his microphone in order to transform it into a polyphonic melody (FIG. 8). Application: Ringing for mobile telephones.

8 Claims, 4 Drawing Sheets

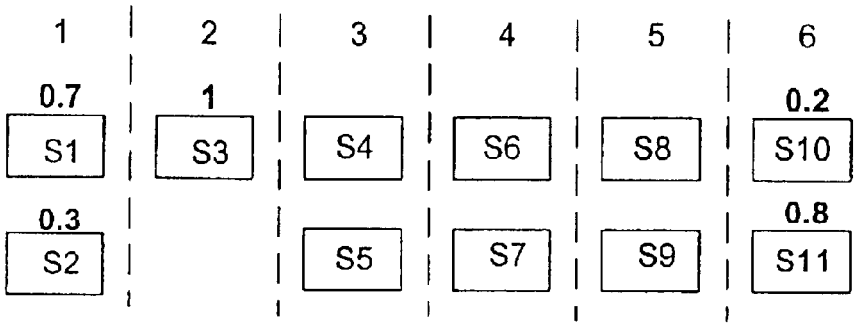
FIG.5
| | S1 | S2 | S3 | S4 | S5 | ----- | S10 | S11 |
|---|---|---|---|---|---|---|---|---|
| S1 | | | 0.2 | | | | | |
| S2 | | | 0.1 | | | | | |
| S3 | | | | | | | 0.1 | 0.4 |
| ⋮ | | | | | | | | |
| S10 | 0.3 | 0.4 | | | | | | |
| S11 | 0 | 0 | | | | | | |
FIG.6
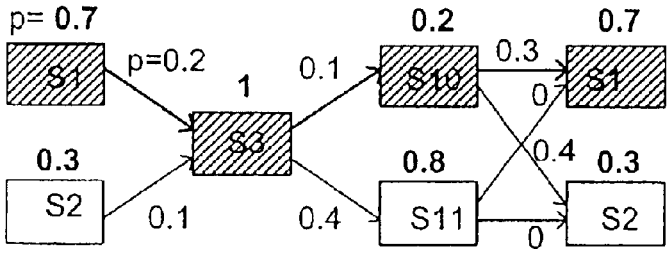
FIG.7

DEVICE COMPRISING A SOUND SIGNAL GENERATOR AND METHOD FOR FORMING A CALL SIGNAL

The invention relates to a device comprising a sound signal generator having an input element and a sound reconstruction element.

The invention also relates to a method for forming a call signal.

The invention finds important applications in particular with regard to the case where the sound signal, replacing traditional ringing, is the call signal for mobile telephones.

Such a device is known from European patent document EP 1 073034. In this known device, the sound signal can have a multitude of tones. However, it is considered that it does not leave enough initiative to the user on the choice of ringing or call melodies.

The present invention proposes a device of the type mentioned in the preamble which gives great initiative with regard to the production of this call signal.

For this purpose, such a device is characterized in that it is provided with a harmonization element for transforming, into a polyphonic melody formed from accompaniment notes, a monodic melody entered by means of said input element, and a connection element for applying said polyphonic melody to the sound reconstruction element.

A method for forming a call signal is characterized in that it comprises the following steps:

entering a monodic melody formed from notes, allocating a chord for the majority of these notes with a view to forming a polyphonic melody, recording this polyphonic melody, applying this polyphonic melody to a sound reconstruction element in order to make a call.

The invention will be further described with reference to examples of embodiment shown in the drawings to which, however, the invention is not restricted. In the drawings:

FIG. 5 shows the states relating to chords allocated to the degrees of a scale.

FIG. 6 shows a second embodiment of the invention.

FIG. 7 is a table intended to allocate values for each state transition.

Figure 1:
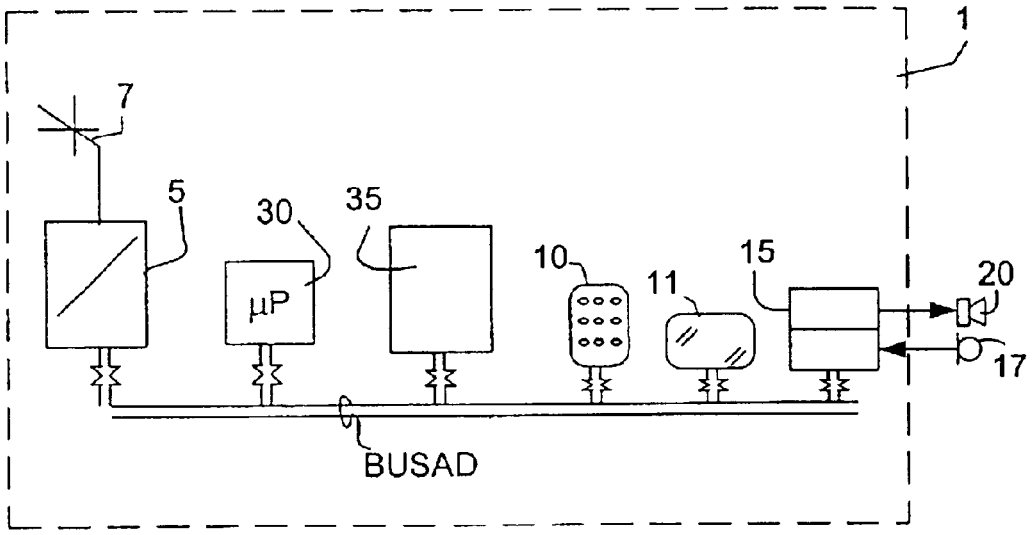
FIG. 1 shows a device according to the invention.

In FIG. 1, the device of the invention bears the reference 1. This device, in the context of the example described, is a mobile telephone for a cellular network. This device has a transceiver part 5 for transmitting and receiving waves by means of an antenna 7, a screen 11, a keypad 10 and also an audio frequency circuit 15 for processing the audio signals which come from a microphone 17 and the signals to be applied to a loudspeaker 20. All the processings are implemented on this device under the control of a processor assembly 30 cooperating with a memory assembly 35 containing, amongst other things, the instructions for these processings. The various items of information supplied and accepted by these various elements pass over a common data line BUSAD.

When the user receives an incoming call which concerns him, the loudspeaker 20 emits a call signal, which the user would wish to be as pleasant as possible or which most seems to him to reflect his personality.

For this purpose, the invention proposes that the user himself should determine the call melody by singing or whistling into the microphone 17. To make the melody more attractive, the device comprises means for forming an accompaniment to this melody.

Figure 2:
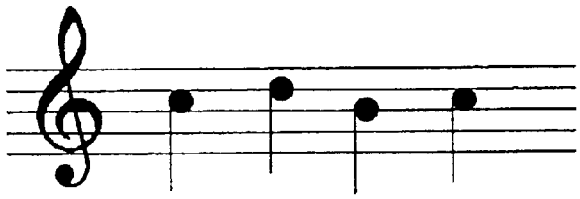
FIG. 2 shows a monodic melody to be transformed according to the invention.

FIG. 2 shows a so-called monodic melody which the user has hummed into his microphone 20. From this monodic melody, an accompaniment will be established using the following operations performed by means in particular of the processor 30 cooperating with the memory assembly 35.

Figure 3:
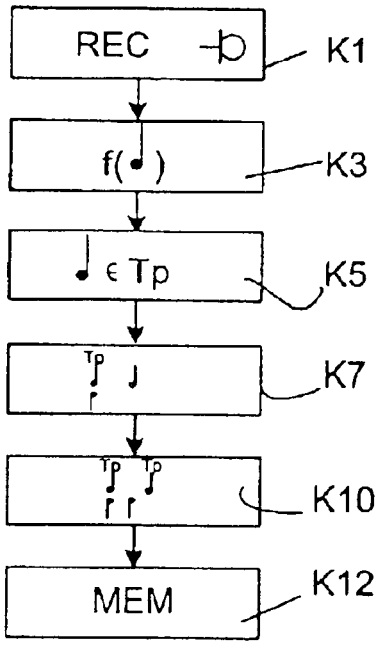
FIG. 3 shows a first operation flow chart of the device of the invention.

FIG. 3 shows a flow chart intended for explaining the functioning of the invention. The box K1 indicates the melody entry step obtained by means, for example, of the microphone 17. Each of the notes entered is analyzed and the frequency of these notes is determined (box K3). At the step indicated by the box K5, it is examined whether the spacing of the notes entered are multiples of the intervals of the tempered scale ($\sqrt[12]{2}$). The notes close to these tempered levels are allocated to an accompanying chord, those too far away are not. The close notes are allocated a flag Tp; this is indicated in box K5. The box K7 indicates the establishment of each of the chords for the notes "Tp" according to a process detailed in FIG. 4. In box K10, which can be an optional step, ornamental notes are added between two successive chords. These ornamental notes are added when two notes in the melody are separated by a third. For example, if the two notes of the melody are doh and me, the ornament will be re. The step indicated in box K12 is a step of recording the melody made polyphonic in the memory assembly 35.

Figure 4:
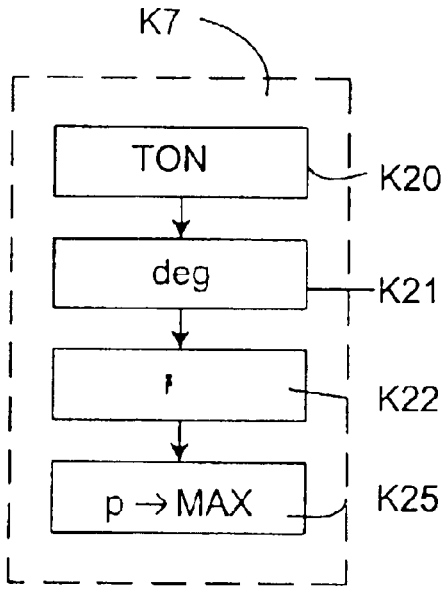
FIG. 4 shows a second operation flow chart of the device of the invention.

FIG. 4 details the process set out in box K7. A processing step consists of finding the tonality of the monodic melody. The last note of the melody may define this (box K20). Then each note is allocated with the degrees of the tonality (box K21), that is to say:

Tonic
Supertonic
Mediant
Subdominant
Dominant
Submediant
Leading note

For each of these degrees there are several possible predefined chords (box K22). Referring to FIG. 5, two chords corresponding to states S1 and S2 have been allocated. For the first degree (tonic) for example, possible chords are doh-me-soh and soh-doh-me, considering the doh major tonality. In these different states, there are also allocated "p" values of coefficients indicated in bold in the states which appear in the example of a monodic melody shown in FIG. 2. FIG. 6 also gives "p" values of transitions between chords. These values are also given for this same example of a melody.

FIG. 7 shows the possible paths for producing the accompaniment with a view to supplying a polyphonic melody. The path is chosen which gives the highest p value sum, and therefore state S1, state S3, state S10 and state S1, the sum of the p values:

$$\Sigma p = 0.7+0.2+1+0.1+0.2+0.3+0.7=3.2$$

This value is the largest considering all the possible paths. The optimum path is chosen by using a Viterbi algorithm for example (box K25, FIG. 4).

Figure 8:
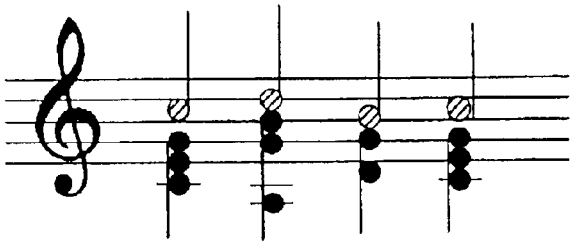
FIG. 8 shows the polyphonic melody obtained by the measures of the invention.

FIG. 8 shows the polyphonic melody thus obtained.

The melody thus recorded is available in order to be applied to the loudspeaker 20. A connection between the memory 35 where it is recorded will be established with the audio frequency circuit 15, via the line BUSAD, so that the call signal can ring.

Figure 9:
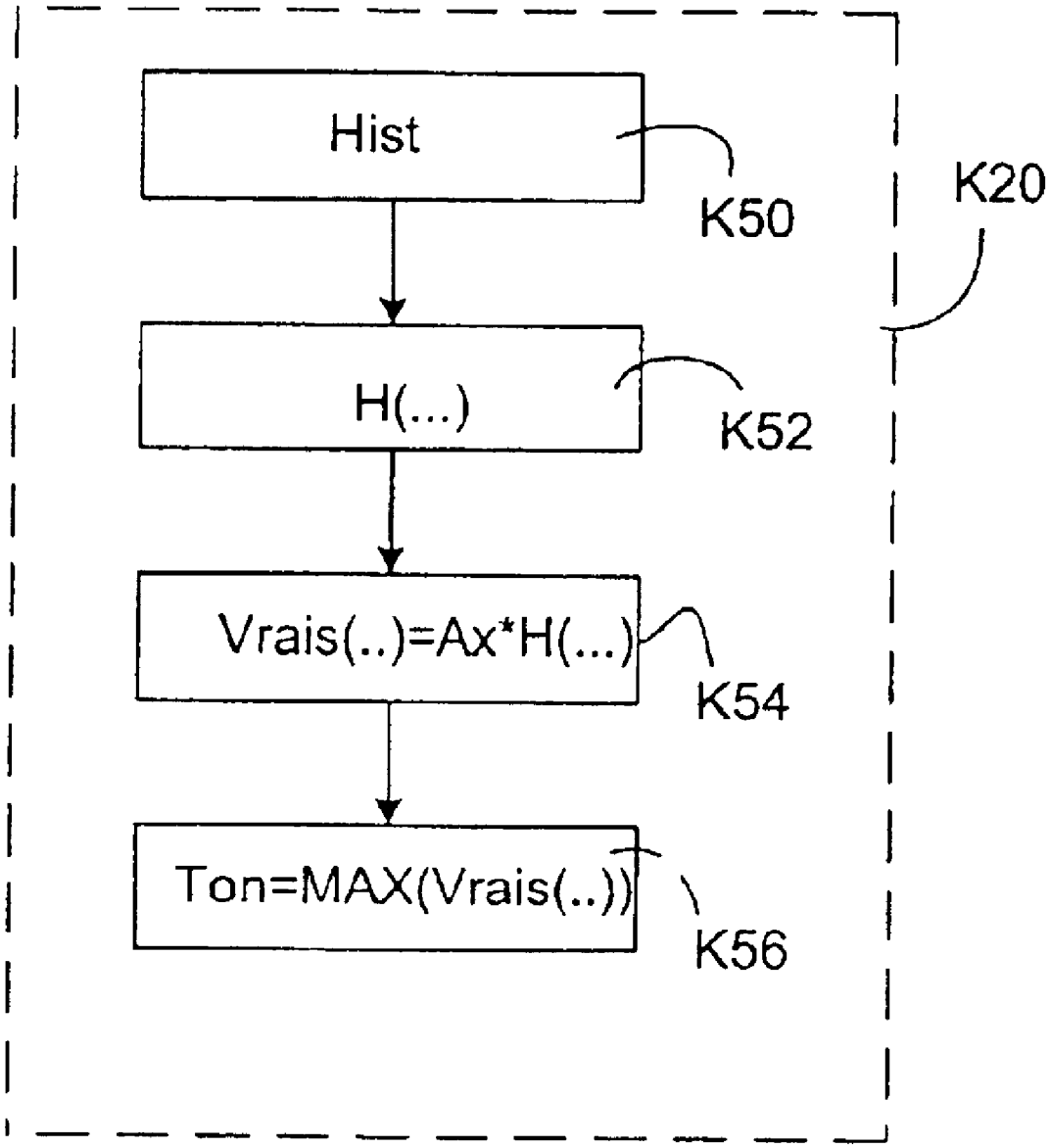
FIG. 9 shows an operation flow chart for determining the key of a melody.

FIG. 9 shows a flow chart defining a variant of box K20 for defining the tonality. It is based on the following considerations.

First of all a histogram of the notes of the melody is established (box K50). That is to say there is a statistic of the number of dohs ($N^o$(doh)), doh# $N^o$(doh#) etc. It is also possible to define a histogram vector of the notes of the melody for each level. That is to say, for H(doh), for example from the histogram (box K52)

H(doh)=[$N^o$(doh), $N^o$(doh#), $N^o$(re), $N^o$(re#), $N^o$(me), $N^o$(fah), $N^o$(fah#), $N^o$(soh), $N^o$(soh#), $N^o$(lah), $N^o$(lah#), $N^o$(te)]

H(doh#)=[$N^o$(doh#), . . .

etc.

where $N^o$(x) designates the number of "x" notes contained in the melody.

The "pillar" notes of the tonality are levels 1, 4 and 5 (tonic, subdominant, dominant).

Levels 2, 3, 6 and 7 are rather less frequent, particularly with simple melodies, which a normal user could enter.

Because of this, two "mask" vectors are defined, one in a major and one in a minor. This mask weights the histogram of the notes of the melody.

For the major mask, it is possible to take the vector

AM=[5; 0; 2; 0; 3; 4; 0; 5; 0; 2; 0; 1].

For the minor mask:

Am=[5; 0; 2; 3; 0; 4; 0; 5; 2; 0; 1; 1].

It is also possible to define masks other than the major and minor modes.

Next, a "likelihood score" is calculated for the Doh Major and Doh minor tonality true(DohM) AM*H(doh)

true (Dohm) Am*H(doh) where the symbol * designates the scalar product.

Next, the "likelihood score" is calculated for the 22 other possible tonalities.

(11 majors from doh#Major to te Major+11 minors from doh#minor to te minor)

by a simple translation of the values of the histogram (box K(54)).

For example H(re)=[$N^o$(re), $N^o$(re#), $N^o$(me), $N^o$(fah), $N^o$(fah#), $N^o$(soh), $N^o$(soh#), $N^o$(lah), $N^o$(lah#), $N^o$(te), $N^o$(doh), $N^o$(doh#),] and true(ReM)=AM*H(Re)

true(Rem)=Am*H(Re)

The final choice of the tonality is a function of the true( ) values obtained.

By way of example, the tonality can be taken which maximizes true( ) (box K56).

It should be noted that the melody can also be entered using the keypad 10 of the device, keys being allocated to musical notes.

What is claimed is:

1. A device comprising a sound signal generator, having an input element and a sound reconstruction element, characterized in that it is provided with a harmonization element for transforming, into a polyphonic melody formed from accompaniment notes, a monodic melody entered by means of said input element, and a connection element for applying said polyphonic melody to the sound reconstruction element, wherein the harmonization element is configured to create initial mask vectors for the major, minor, and other tonalities, create a histogram of all the notes, create a vector for each degree of the scales, determine a scalar product of the vectors of degrees and the mask vectors, and allocate the tonality according to the maximum values of this scalar product.

2. A device as claimed in claim 1, characterized in that the input element is a microphone cooperating with a sound analyzer in order to supply scale notes of said melody.

3. A device as claimed in claim 2, characterized in that the harmonization element comprises a chord library for each scale level and a choosing element for determining the chord to be applied to each note of said melody.

4. A device as claimed in claim 2, characterized in that the choosing element has means for optimizing a harmony circuit from coefficients supplied to each of the chords and to the transitions between each chord.

5. A device as claimed in claim 2, characterized in that the harmonization element has means of adding additional accompaniment notes.

6. A device as claimed in claim 2, characterized in that the harmonization element has selection means for determining the notes to which the chords will be allocated.

7. A method for generating sound signals in a device, the method comprising the acts of:

entering a monodic melody formed from notes allocating a chord for the majority of these notes with a view to forming a polyphonic melody recording this polyphonic melody applying this polyphonic melody to a sound reconstruction element for making a call, characterized in that it comprises the following further acts for determining the tonality of the monodic melody:

creating initial mask vectors for the major and minor tonalities or others determining a histogram of all the notes creating a vector for each degree of the scales determining a scalar product of the vectors of degrees and the mask vectors allocating the tonality according to the maximum values of this scalar product.

8. The method of claim 7, comprising the acts of:

analyzing individual notes of the monodic melody, determining the frequency of the individual notes, determining if the spacing of the individual notes are multiples of the intervals of a level of a tempered scale, and allocating only notes that are within a predetermined amount of the level to an accompanying chord.

* * * * *